US012478111B2

(12) United States Patent
Prestia

(10) Patent No.: US 12,478,111 B2
(45) Date of Patent: Nov. 25, 2025

(54) CHARGER AND AEROSOL-GENERATING SYSTEM WITH A MULTI-COMPONENT COVER

(71) Applicant: Philip Morris Products S.A., Neuchatel (CH)

(72) Inventor: Ivan Prestia, Bologna (IT)

(73) Assignee: Philip Morris Products S.A., Neuchatel (CH)

( * ) Notice: Subject to any disclaimer, the term of this patent is extended or adjusted under 35 U.S.C. 154(b) by 808 days.

(21) Appl. No.: 17/768,398

(22) PCT Filed: Oct. 16, 2020

(86) PCT No.: PCT/EP2020/079290

§ 371 (c)(1),
(2) Date: Apr. 12, 2022

(87) PCT Pub. No.: WO2021/074436

PCT Pub. Date: Apr. 22, 2021

(65) Prior Publication Data

US 2023/0111319 A1 Apr. 13, 2023

(30) Foreign Application Priority Data

Oct. 17, 2019 (EP) ..... 19203950

(51) Int. Cl.
*H02J 7/00* (2006.01)
*A24F 40/40* (2020.01)
*A24F 40/95* (2020.01)

(52) U.S. Cl.
CPC ..... *A24F 40/95* (2020.01); *A24F 40/40* (2020.01)

(58) Field of Classification Search
None
See application file for complete search history.

(56) References Cited

U.S. PATENT DOCUMENTS 3,863,760 A * 2/1975 Il ..... A24F 15/14 206/250
5,617,880 A * 4/1997 Landuydt ..... A24F 19/14 131/237

(Continued)

FOREIGN PATENT DOCUMENTS

CN 205512351 U 8/2016
CN 207927769 U 10/2018

(Continued)

OTHER PUBLICATIONS

International Search Report and Written Opinion issued Feb. 12, 2021 in PCT/EP2020/079290 filed on Oct. 16, 2020, 10 pages.

(Continued)

*Primary Examiner* — Arun C Williams
(74) *Attorney, Agent, or Firm* — Oblon, McClelland, Maier & Neustadt, L.L.P.

(57) ABSTRACT

A charger for charging an aerosol-generating device is provided, the charger including: a housing defining a cavity to receive the device to be charged, the cavity having an opening; at least one electrical contact disposed in the cavity; and a cover including a plurality of moveable elements actuatable between open and closed positions, each of the moveable elements having an inner surface facing the cavity when in the closed position, at least a portion of the inner surface of at least one of the moveable elements defines a profiled engagement member having leading and trailing edges, and the profiled engagement member slopes into, or towards, the cavity when the respective moveable element is in the closed position, the slope increasing in a direction from the leading to the trailing edge. An aerosol-generating system including the charger and the device, and a method of using the system are also provided.

15 Claims, 8 Drawing Sheets

(56) References Cited

U.S. PATENT DOCUMENTS

| | | | | |
|---|---|---|---|---|
| 2003/0063523 | A1* | 4/2003 | Mulaw | A24F 15/005 368/10 |
| 2010/0313901 | A1* | 12/2010 | Fernando | B65D 85/1081 131/330 |
| 2012/0227753 | A1* | 9/2012 | Newton | A24F 40/95 131/347 |
| 2013/0333711 | A1* | 12/2013 | Liu | A24F 40/60 131/329 |
| 2013/0336358 | A1* | 12/2013 | Liu | G01K 13/20 374/152 |
| 2013/0342157 | A1* | 12/2013 | Liu | A24F 40/95 320/107 |
| 2014/0020697 | A1* | 1/2014 | Liu | H02J 50/005 320/108 |
| 2014/0053858 | A1* | 2/2014 | Liu | A24F 40/40 131/329 |
| 2014/0097103 | A1 | 4/2014 | Cameron | |
| 2014/0107815 | A1* | 4/2014 | LaMothe | A24F 15/01 700/90 |
| 2015/0245668 | A1* | 9/2015 | Memari | A24F 40/90 206/250 |
| 2015/0333542 | A1* | 11/2015 | Alarcon | H02J 7/007 131/328 |
| 2015/0333552 | A1* | 11/2015 | Alarcon | H02J 7/345 131/329 |
| 2017/0048930 | A1* | 2/2017 | Marsh | B65B 3/04 |
| 2017/0334605 | A1* | 11/2017 | Murphy | F01N 13/1805 |
| 2017/0347709 | A1 | 12/2017 | Laakso et al. | |
| 2019/0008208 | A1 | 1/2019 | Cirillo et al. | |
| 2019/0223499 | A1 | 7/2019 | Ouyang | |
| 2019/0267823 | A1* | 8/2019 | Zheng | A24F 40/95 |
| 2020/0221773 | A1 | 7/2020 | An | |
| 2020/0221782 | A1 | 7/2020 | Lim | |
| 2020/0229501 | A1 | 7/2020 | Han et al. | |
| 2020/0268047 | A1 | 8/2020 | Doyle | |
| 2020/0268055 | A1 | 8/2020 | An | |
| 2020/0281273 | A1 | 9/2020 | Kim et al. | |
| 2020/0288778 | A1 | 9/2020 | Kim et al. | |
| 2020/0323264 | A1 | 10/2020 | Kim et al. | |
| 2020/0329772 | A1 | 10/2020 | Kim et al. | |
| 2020/0337374 | A1 | 10/2020 | Han et al. | |
| 2020/0345076 | A1 | 11/2020 | Lim et al. | |
| 2020/0345960 | A1 | 11/2020 | Begin et al. | |
| 2020/0359693 | A1 | 11/2020 | Lee et al. | |
| 2020/0359695 | A1 | 11/2020 | Lim | |
| 2020/0359696 | A1 | 11/2020 | Lim | |
| 2020/0359698 | A1 | 11/2020 | Lim et al. | |

FOREIGN PATENT DOCUMENTS

| | | | |
|---|---|---|---|
| CN | 208863590 | U | 5/2019 |
| CN | 209017885 | U | 6/2019 |
| CN | 209017886 | U | 6/2019 |
| CN | 209134088 | U | 7/2019 |
| EP | 3 125 707 | A1 | 2/2017 |
| EP | 3 484 012 | A1 | 5/2019 |
| EP | 3 513 670 | A1 | 7/2019 |
| GB | 2 523 585 | A | 9/2015 |
| JP | 2017-532009 | A | 11/2017 |
| JP | 2018-501789 | A | 1/2018 |
| KR | 10-1874369 | B1 | 7/2018 |
| KR | 10-2019-0049647 | A | 5/2019 |
| KR | 10-2019-0100774 | A | 8/2019 |
| KZ | 31 485 | B | 9/2016 |
| RU | 2 614 376 | C2 | 3/2017 |
| WO | WO 2019/037881 | A1 | 2/2019 |
| WO | WO 2019/081602 | A1 | 5/2019 |
| WO | WO 2019/084161 | A1 | 5/2019 |
| WO | WO 2019/164135 | A1 | 8/2019 |

OTHER PUBLICATIONS

Japanese Office Action issued Sep. 26, 2024 in Japanese Patent Application No. 2022-522028 (with English Translation), citing references 15-22 therein, 12 pages.

Combined Russian Decision to Grant and Search Report issued Feb. 6, 2024 in Russian Patent Application No. 2022112865/03 (with English Translation), citing references 15-20 therein, 20 pages.

Combined Chinese Office Action and Search Report issued on Apr. 1, 2025 in Chinese Patent Application No. 202080072490 (with unedited computer-generated English translation), citing document 15 therein, 30 pages.

* cited by examiner

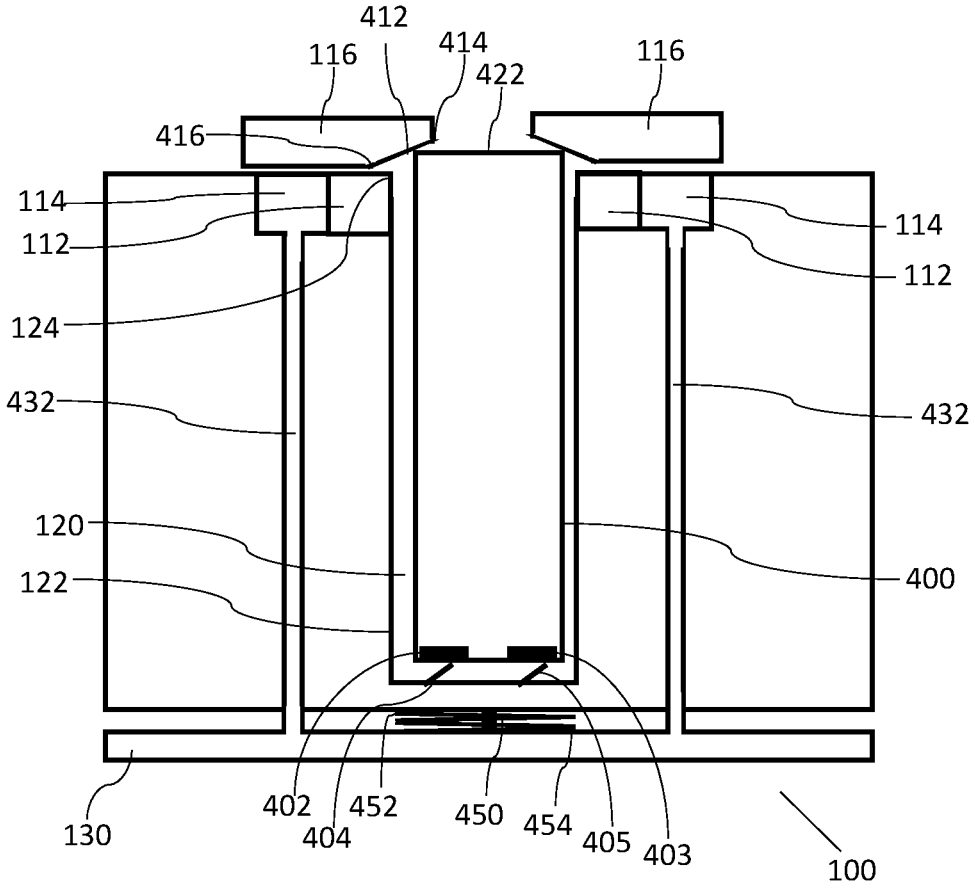
Figure 4c
Figure 4
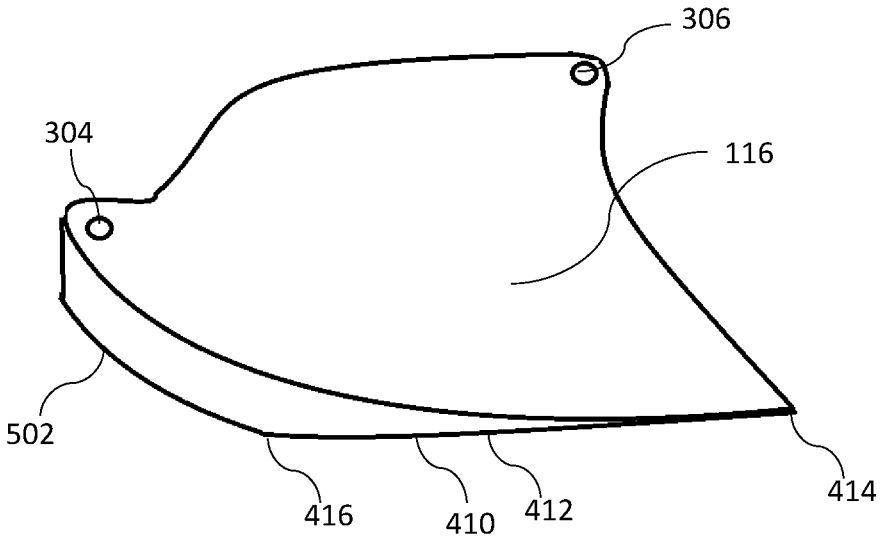
Figure 5

CHARGER AND AEROSOL-GENERATING SYSTEM WITH A MULTI-COMPONENT COVER

The disclosure relates to a charger for receiving an aerosol-generating article having an improved closing means, an aerosol-generating system comprising the charger and a method of using the aerosol-generating system.

Electrically operated aerosol-generating systems generally comprise an aerosol-forming substrate and an atomiser, which is operated to atomise volatile compounds in the aerosol-forming substrate to form an aerosol for inhalation by a user. Typically, electrically operated aerosol-generating systems also comprise an aerosol-generating device comprising an electrical power supply for supplying power to the atomiser. The atomiser may be an electrically operated heating means, for example an electric heater.

In some systems, an aerosol-generating device is configured to receive an aerosol-generating article comprising a solid aerosol-forming substrate, for example a substrate comprising homogenised tobacco. In these systems, the device typically comprises the atomiser, which is arranged to heat the aerosol-forming substrate when the article is received in the device and a power source connected to the atomiser in the form of a rechargeable battery.

Some electrically operated aerosol-generating systems comprise a separate charger for releasably receiving and recharging the aerosol-generating device when not in use. Typically, the aerosol-generating device will be used frequently. For example, the aerosol-generating device may be used a number of times a day. Therefore, the user will frequently insert and remove the aerosol-generating device into the charger throughout a day.

In some aerosol-generating systems, the charger further comprises a cover. The cover may be moveable from an open position, in which the aerosol-generating device can be received by the charger, and a closed position, in which the aerosol-generating device is protected from dust.

The charger usually comprises an electrical contact. The aerosol-generating device also usually comprises an electrical contact. In order for an aerosol-generating device, received in the charger, to be recharged, the aerosol-generating device should be positioned in the charger such that the electrical contact of the aerosol-generating device is in electrical connection with the electrical contact of the charger when the aerosol-generating device is received in the charger. In the closed position, the cover also prevents users from altering the position of the aerosol-generating device within the charger. However, an electrical connection may not be consistently maintained if the charger is stored in a particular orientation or is dropped by a user of the device. If electrical connection is not consistently maintained while the aerosol-generating device is received in the charger then the aerosol-generating device may not recharge properly. The risk of this is particularly high when the aerosol-generating system is a portable system. Furthermore, there is a risk that the cover may be unintentionally forced from the closed position to the open position.

Furthermore, in many aerosol-generating systems, the cover, in the open position, is typically at risk of being damaged. This is particularly true if the cover, in an open position, protrudes from the charger. For example, the cover may be moveable around a rotation axis wherein, in the closed position, the cover is substantially parallel to and adjacent to a surface of the charger. Having been rotated about the rotational axis, the cover, in the open position, is substantially perpendicular to that surface of the charger.

When the charger protrudes perpendicularly in such a manner, there is a risk of the cover being damaged.

It would be desirable to provide a charger allowing for reliable and efficient charging by ensuring electrical connection between the charger and an aerosol-generating device received in that charger. Given the frequency of use of the aerosol-generating system, it would be desirable to provide a charger that can quickly and simply be manipulated by a user of the device. It would also be desirable to provide a charger with a cover that is robust.

In this disclosure there is provided a charger for charging an aerosol-generating device. The charger may comprise a housing defining a cavity for receiving the aerosol-generating device to be charged. The cavity may have an opening. At least one electrical contact may be located in the cavity. The charger may comprise a cover. The cover may comprise a plurality of moveable elements. The moveable elements may be actuatable between an open position and a closed position. Each of the moveable elements may have an inner surface facing the cavity when in the closed position. At least a portion of the inner surface of at least one of the moveable elements of the cover may define a profiled engagement member. The profiled engagement member may have a leading edge and a trailing edge. The profiled engagement member may slope into, or towards, the cavity when the respective moveable element is in the closed position. The slope may increase in a direction from the leading edge to the trailing edge of the profiled engagement member.

In one example, the charger for charging an aerosol-generating device may comprise a housing defining a cavity for receiving the aerosol-generating device to be charged, the cavity having an opening, at least one electrical contact being located in the cavity; and a cover comprising a plurality of moveable elements actuatable between an open position and a closed position, each of the moveable elements having an inner surface facing the cavity when in the closed position, in which; at least a portion of the inner surface of at least one of the moveable elements of the cover defines a profiled engagement member having a leading edge and a trailing edge, the profiled engagement member sloping into, or towards, the cavity when the respective moveable element is in the closed position, the slope increasing in a direction from the leading edge to the trailing edge of the profiled engagement member.

When the plurality of moveable elements are in the open position, an aerosol-generating device can be received by the charger in the cavity. When the plurality of moveable elements are in the closed position an aerosol-generating device, received by the charger, is protected from dust and dirt from the surroundings of the charger. In the closed position, the plurality of moveable elements also prevent users from altering the position of the aerosol-generating device within the charger. Electrical contact between the at least one electrical contact of the charger and the aerosol-generating device is ensured when the plurality of moveable elements are in the closed position. Such a charger, advantageously, allows for reliable and efficient charging of the aerosol-generating device received in the cavity.

The cover comprising a plurality of moveable elements actuatable between an open position and a closed position advantageously reduces the footprint of the cover compared to a cover comprising a single moveable element. This allows the charger housing to be more compact. This is particularly advantageous when the charger is a portable charger.

The profiled engagement member sloping into or towards the cavity, when the plurality of moveable elements are in the closed position, advantageously allows engagement of the aerosol-generating device received in the cavity. By engaging the aerosol-generating device, the profiled engagement member advantageously retains the aerosol-generating device in a predetermined position within the cavity. In the predetermined position, the aerosol-generating device may be in electrical connection with the charger. The engagement of the profiled engagement member with aerosol-generating device may advantageously ensure electrical connection between the aerosol-generating device and the charger irrespective of the orientation of the charger or if sudden forces are applied to the charger, for example, in the case that the charger is dropped.

Electrical connection between the aerosol-generating device and the charger may be achieved when the aerosol-generating device is retained in contact with the at least one electrical contact located in the cavity. In particular, electrical connection may be achieved when at least one electrical contact on the aerosol-generating device is retained in contact with the at least one electrical contact located in the cavity.

As used herein, the term "profiled engagement member" relates to a portion of the of the inner surface of at least one of the plurality of moveable elements of the cover that is configured to engage a surface of an aerosol-generating device received in the cavity of the charger by coming into contact with that surface of the aerosol-generating device when the cover is in the closed position. The profiled engagement member may engage the aerosol-generating device at some intermediate position of the cover (i.e. at a position between open position and the closed position) and remain engaged with the aerosol-generating device as the cover slides from the intermediate position to the closed position.

As used herein, the term "inner surface of the cover" means a surface of the cover facing the housing of the charger. When the cover is in the closed position, this inner surface faces the cavity defined in the housing of the charger.

Preferably, each of the plurality of moveable elements may comprise a profiled engagement member sloping into, or towards, the cavity when the respective moveable element is in the closed position, the slope increasing in a direction from the leading edge to the trailing edge of the profiled engagement member. Each of the profiled engagement members may engage the aerosol-generating device when the moveable elements are in the closed position. This advantageously results in there being multiple points of contact between the plurality of moveable elements and the aerosol-generating device.

Preferably, when more than one moveable element comprises a profiled engagement member, the slope of each of the profiled engagement members is the same.

The cover may comprise an actuating plate. The actuating plate may be rotatable relative to the charger housing. Rotation of the actuation plate may actuate the plurality of moveable elements from the open position to the closed position.

The actuating plate may be in the shape of a ring. The actuating plate may be concentric with the cavity. The cover may also comprise a base plate. The base plate may be in the shape of a ring.

The base plate ring may be concentric with the cavity and the actuating plate ring. The base plate ring may be positioned inside the actuating plate ring. Alternatively, the actuating plate ring may be positioned inside the base plate ring. The inner ring of the base plate and the actuating plate may have a diameter that corresponds to the dimensions of the cavity opening. For example, the diameter of the inner ring may be equal to the diameter of the cavity opening.

Each of the plurality of moveable elements may be connected to the actuating plate. The may be via an actuation arm fixed to the actuating plate at one end and fixed to the moveable element at another end.

Each of the plurality of moveable elements may also be connected to the charger housing. Alternatively, each of the plurality of moveable elements may also be connected to the base plate. The connection to the base plate or the charger housing may be via a pin formed in the base plate or the charger housing.

By connecting each of the plurality of moveable elements to the actuating plate and to the base plate or charger housing, rotating the actuating plate may actuate the moveable elements from the open position to the closed position.

The connection of each of the plurality of moveable elements to the base plate or charger housing may be offset relative to each of the connections of the plurality of moveable elements to the actuating plate such that rotation of the actuation plate causes the moveable elements to actuate around a pivot.

The cover may comprise an iris mechanism. An iris mechanism advantageously has a small footprint, compact and robust. The plurality of moveable elements may form part of the iris mechanism. The iris mechanism may also comprise the actuating plate. The iris mechanism may also comprise the base plate.

The cover may comprise between 2 and 6 moveable elements.

The plurality of moveable elements may not overlap in the closed position. The plurality of moveable elements may not overlap in the open position. This may be possible because of moveable elements are connected via an actuation arm. A non-overlapping arrangement advantageously allows for an iris mechanism where at least one of the moveable elements having a profiled engagement member.

In the closed position, the plurality of moveable elements may be in contact with one another to form a continuous surface. The continuous surface may face the cavity opening of the charger and close the cavity. In other words, in the closed position, the plurality of moveable elements may align when in the closed position. This advantageously closes the cavity to the surroundings.

The or each profiled engagement member may be configured to urge an aerosol-generating device received in the cavity into engagement with the at least one electrical contact when the plurality of moveable elements are in the closed position. This advantageously ensures that electrical communication is retained between the aerosol-generating device and the charger. By urging the aerosol-generating device into contact with the at least one electrical contact of the charger, the electrical resistance between the at least one contact and the aerosol-generating device may be significantly reduced. This may ensure efficient charging of the aerosol-generating device.

As used herein, the term "urges" or "urging" means that a force is applied by one component to another component.

The or each profiled engagement member may protrude into, or towards, the cavity when the plurality of moveable members are in the closed position. The protrusion of the profiled engagement member may increase in a direction from the leading edge to the trailing edge of the profiled engagement member. This is a result of the slope of the profiled engagement member increasing into or toward the cavity from the leading edge to the trailing edge.

Preferably, the leading edge may not extend into, or toward, the cavity enough to engage with an aerosol-generating device received in the cavity. Therefore, when the plurality of moveable elements are actuated from the open position to the closed position, the profiled engagement member does not immediately engage the aerosol-generating device received in the cavity. Actuating the plurality of moveable elements further toward the closed position may cause the profiled engagement portion to protrude into or towards the cavity to an extent it that engages an aerosol-generating device received in the cavity and then increasingly urges the aerosol-generating device into engagement with the at least one electrical contact. This configuration advantageously results in a smooth engagement of the profiled engagement member with the aerosol-generating device.

Preferably, when more than one of the plurality moveable elements comprises a profiled engagement member, each profiled engagement member engages the aerosol-generating device at the same point in the motion of the plurality of moveable elements between the open position and the closed position. Preferably, each profiled engagement member urges the aerosol-generating device equally. This advantageously ensures that an even force is applied to the aerosol-generating device, urging the aerosol-generating device into engagement with the at least one electrical contact.

Actuation of the plurality of moveable elements from the open position to the closed position may move the or each profiled engagement into an overlapping relationship with the cavity. In this overlapping relationship with the cavity, the or each profiled engagement member can advantageously interact with, and engage, an aerosol-generating device in the cavity. The leading edge may move into an overlapping relationship with the cavity first as the respective moveable element is actuated from the open position to the closed position.

The slope of the profiled engagement member may increase linearly into or toward the cavity from the leading edge to the trailing edge. Alternatively, the slope may increase non-linearly. For example, the rate of change of increase of the slope may increase from the leading edge to the trailing edge. The increasing protrusion into or toward the cavity of such a cover may be slow at first and then increase more rapidly as the cover slides from the open position. The non-linear slope may be configured such that there is a smooth engagement of the profiled engagement member while the rate of increase of the slope is low, and then, once there is engagement, the aerosol-generating device may be quickly urged into the cavity, ensuring electrical connection.

While reference to the plurality of moveable elements being actuatable from the open position to the closed position is made throughout, the moveable elements may be equally actuatable from the closed position to the open position.

Preferably, the at least one electrical contact of the charger is a resilient element.

As used herein, the term "resilient element" relates to an element that may be deformed or deflected by an applied force, but is capable of returning to its original position or state after the applied force is removed. When a resilient element is deformed or deflected by a force applied by a component moving towards the resilient element, the resilient element generates a reactive force that urges the component to move away from the resilient element. Examples of resilient elements include helical springs and cantilever springs.

The at least one electrical contact may be a resilient element configured to apply a force to an aerosol-generating device received in the cavity in the direction of the cavity opening when the plurality of moveable elements are in the closed position. The force applied by the resilient element advantageously urges the aerosol-generating device against the cover and, in particular, against the profiled engagement member of the cover. The cover in the closed position advantageously ensures electrical communication between the aerosol-generating device and the charger.

The charger may comprise an aerosol-generating device release mechanism. The aerosol-generating device release mechanism may be located in the cavity. The aerosol-generating device release mechanism may comprise a resilient element. The resilient element may be configured to urge an aerosol-generating device received in the cavity in the direction of the cavity opening when the plurality of moveable elements are in the closed position. By urging the aerosol-generating device out of the cavity, the aerosol-generating device may be more easily removed from the charger by a user of the device. This is because a region of the aerosol-generating device upon which a user can hold on to may be provided. A user of the charger can grab onto, and interact with, this region making it easier to insert or remove an aerosol-generating from the charger. The aerosol-generating device release mechanism may be configured to urge the aerosol-generating device at least partially out of the cavity when the plurality of moveable elements are in the open position.

The aerosol-generating release mechanism may be a resilient element in the form of a helical spring or cantilever spring that is located in the cavity of the charger.

The charging device may comprise a primary power source. The primary power source may be electrically couplable to the at least one electrical contact of the charger. The aerosol-generating device may comprise a secondary power source. The secondary power source may be electrically couplable to the at least one electrical contact of the aerosol-generating device.

The primary power source and the secondary power source may comprise any suitable types of electrical power supplies. The primary power source and the secondary power source may comprise one or more of batteries and capacitors. The primary power source and the secondary power source may comprise lithium ion batteries. The primary power source and the secondary power source may be rechargeable electrical power supplies. The primary power source and the secondary power source may be identical. The primary power source and the secondary power source may be different. The primary power source may have a larger size than the secondary power source of the aerosol-generating device. When the charger and the aerosol-generating device are electrically connected this may allow electrical communication between the primary power source and the second power source. Electrical communication between the primary power source and the secondary power source may allow the primary power source to be used to recharge the secondary power source. Therefore, the profiled engagement member ensuring connection between the aerosol-generating device and the charger advantageously ensures that the primary source recharges the secondary power source when the aerosol-generating device is received in the charger and the plurality of moveable elements are in the closed position.

The cavity of the charger may have dimensions that substantially correspond to the dimensions of the aerosol-generating device to be received in the cavity. Preferably, the cavity is an elongate cavity extending from an opening in a surface of the cartridge housing to a closed end located within the cartridge housing. The length of the cavity from its opening to its closed end is preferably substantially similar to the length of the aerosol-generating device to be received in the cavity. An aerosol-generating device received in the cavity of the charger may extend out of or above the opening of the cavity when received in the cavity. This extension out of, or above, the cavity may be the result of the at least one electrical contacts of the charger urging the aerosol-generating device out of the cavity.

The or each profiled engagement member may be a cam surface. A surface of the aerosol-generating device received in the cavity may be a cam rider. In particular, the top surface of the aerosol-generating device may be a cam rider. If there is more than one profiled engagement member, each profiled engagement may be an individual cam surface, and different portion of a surface of the aerosol-generating device may be a cam rider.

As used herein, the term "cam surface" refers to a surface of a first component that is configured to contact a portion of a second component. As used herein, the term "cam rider" refers to a portion of the second component configured to contact the cam surface. The cam surface and cam rider are configured such that motion of the first component is transferred to the second component via the contact between cam surface and the cam rider. Typically, the cam surface passes over the cam rider.

The profiled engagement member, as a cam surface, may be configured to transfer a transverse motion from the respective moveable element to the aerosol-generating device, as a cam rider. The aerosol-generating device may follow or ride the slope of the profiled engagement member as the cover moves from the open position to the closed position. As the profiled engagement member slopes into, or towards, the cavity, the aerosol-generating device is pushed in a direction towards the cavity when the cover is moved from the open position to the closed position. This advantageously urges the aerosol-generating device against the electrical contact in the cavity.

The aerosol-generating device may only ride the profiled engagement member after the or each profiled engagement member has engaged that aerosol-generating device.

Each moveable elements may move between the open position and the closed position in an actuation plane. Each moveable element may move in the same actuation plane. Each moveable element may move in a different actuation plane.

As used herein, the term "actuation plane" refers to a plane in which the cover lies when the cover is in the closed position, the open position, or an intermediate position between the closed position and the open position. The actuation plane may lie in an x and y direction in a Cartesian coordinate system. The moveable element may substantially extend in the x and y directions.

The direction of the slope of the profiled engagement member may be out of the actuation plane of the respective moveable element. The profiled engagement member may slope out of the actuation plane towards the cavity, when the respective moveable element is in the closed position.

As used herein, the term "out of the actuation plane" means that a non-zero component of the slope of the profiled engagement member lies in a direction that is orthogonal to both the x-direction and the y-direction defined by the actuation plane. In other words, a non-zero component of the slope of the profiled engagement member is in a z-direction in the Cartesian coordinate system defined by the actuation plane.

Each moveable element may comprise an outer surface extending substantially parallel to the actuation plane. The outer surface may be positioned on an opposite side of the moveable element to the inner surface. The inner surface of the moveable element may comprise a portion that does not slope into, or towards, the cavity when the moveable element is in the closed position. The portion of the inner surface of the cover may extend substantially parallel to the sliding plane. The portion of the inner surface of the cover may extend substantially parallel to the outer surface of the cover.

The housing of the charger may comprise a front wall, a back wall, a bottom wall, a top wall, a first side wall and a second side wall. The housing of the charger may be a parallelepiped.

The housing of the charger may comprise a top wall, a bottom wall and a side wall. The housing of the charger may be cylindrical.

The terms "front", "back", "upper", "lower", "side", "top", "bottom", "left", "right" and other terms used to describe relative positions of the components of the charger and the aerosol-generating device refer to the charger in an upright position with the opening of the cavity configured to receive the aerosol-generating device at the top end. The cavity may be formed in the top end. The actuation plane, described above, may be substantially parallel to the top end.

The term "longitudinal" refers to a direction from bottom to top or vice versa.

The housing of the charger may comprise a face over which the plurality of moveable elements are actuatable. This may be the top surface. When actuating the plurality of moveable elements from the open position to the closed position, the inner surface of the cover may not slide beyond the face of the housing. The moveable elements may not protrude from the charger housing when in the open position and so there is no position in which the cover has an increased risk of damage. The face of the housing may lie in a plane substantially parallel to the actuating plane described above. Such an arrangement is advantageously robust.

The charger may comprise an actuation member. The charger may comprise a means to actuate the plurality of moveable elements from the closed position to the open position in response to manipulation of the actuation member by a user of the charger. By providing an actuation member to operate the cover, the process of opening and closing the charger is simplified and made more comfortable for the user. For example, an actuation member on the charger housing may advantageously be positioned such that a user holding the charger in one hand can use that same hand to manipulate the actuation member. This may be more comfortable than moving the cover itself. The actuation member may be positioned on a front side of the charger housing.

The actuation member may be a rotatable disc. When the actuation member is a rotatable disc, the charger housing is preferably cylindrical. The rotatable disc may be positioned parallel to the bottom surface of the charger. The rotatable disc may have a diameter equal to the diameter of cylindrical charger.

The rotatable disc may be configured to be rotated be a user of the charger. Rotation of the rotatable disc may cause the moveable elements to move from the open position to the closed position. The means to actuate the plurality of moveable elements may be a mechanical linkage between the rotatable disc and the cover. The mechanical linkage may be at least one rigid shaft connecting the rotatable disc to the actuating plate. The mechanical linkage may be configured such that rotation of the rotatable disc causes rotation of the actuating plate of the cover.

The actuation member may be a slider. When the actuation member is a rotatable disc, the charger housing is preferably a parallelepiped. The means to actuate the plurality of moveable elements may be a mechanical linkage between the slider and the cover. The mechanical linkage may be configured such that the movement of the slider is transferred to the cover. In particular, the movement of the slider may be transferred to the cover as rotational motion. The rotational motion may be transferred to the actuating plate of the cover and may cause rotation of the actuation ring of the cover.

Alternatively, the actuation member may be a button or switch. The means to slide the cover may comprise an actuator and a mechanical linkage between the actuator and the cover. The actuation member may be configured to send an electrical signal to actuator in response to manipulation of the actuation member by a user of the charger. The actuator may be an electric motor configured to create rotational motion. This rotational motion may transferred to the cover and, particularly, to the actuating plate, via the mechanical linkage.

The plurality of moveable elements may be biased towards the closed position. The moveable elements being biased to the closed position advantageously means that the moveable elements are urged towards the closed position. Whenever the moveable elements are in the open position a biasing force may urge them back to the closed position automatically. This advantageously prevents the user from inadvertently leaving the cover in the open position. It also advantageously means that if the cover is inadvertently forced open, for example when the charger is stored in a user's pocket, it will automatically close again. The biasing element may be via a plurality of springs. Each spring may be attached to one of the plurality of moveable elements at one end and to the housing of the charge at the other end. Alternatively, one end of the spring may be attached to a base plate of the cover and the other end may be attached to the actuation plate of the cover.

As used herein, the term 'aerosol-generating device' refers to a device that interacts with an aerosol-forming substrate to generate an aerosol that is directly inhalable into a user's lungs through the user's mouth. In certain embodiments, an aerosol-generating device may heat an aerosol-forming substrate to facilitate the release of the volatile compounds. An aerosol-generating device may interact with an aerosol-generating article comprising an aerosol-forming substrate or a cartridge comprising an aerosol-forming substrate. An electrically operated aerosol-generating device may comprise an atomiser, such as an electric heater, to heat the aerosol-forming substrate to form an aerosol.

As used herein, the term 'aerosol-forming substrate' is used to describe a substrate capable of releasing upon heating volatile compounds, which can form an aerosol. The aerosol generated from aerosol-forming substrates of aerosol-generating articles described herein may be visible or invisible and may include vapours (for example, fine particles of substances, which are in a gaseous state, that are ordinarily liquid or solid at room temperature) as well as gases and liquid droplets of condensed vapours.

The aerosol-forming substrate may be a solid aerosol-forming substrate. The aerosol-forming substrate may comprise both solid and liquid components.

Preferably, the aerosol-forming substrate comprises nicotine. More preferably, the aerosol-forming substrate comprises tobacco.

Alternatively or in addition, the aerosol-forming substrate may comprise a non-tobacco containing aerosol-forming material.

If the aerosol-forming substrate is a solid aerosol-forming substrate, the solid aerosol-forming substrate may comprise, for example, one or more of: powder, granules, pellets, shreds, strands, strips or sheets containing one or more of: herb leaf, tobacco leaf, tobacco ribs, expanded tobacco and homogenised tobacco.

Optionally, the solid aerosol-forming substrate may contain tobacco or non-tobacco volatile flavour compounds, which are released upon heating of the solid aerosol-forming substrate. The solid aerosol-forming substrate may also contain one or more capsules that, for example, include additional tobacco volatile flavour compounds or non-tobacco volatile flavour compounds and such capsules may melt during heating of the solid aerosol-forming substrate.

Optionally, the solid aerosol-forming substrate may be provided on or embedded in a thermally stable carrier. The carrier may take the form of powder, granules, pellets, shreds, strands, strips or sheets. The solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use.

If the aerosol-forming substrate is a liquid, the aerosol-generating article or cartridge may comprise a means for retaining the liquid substrate. The aerosol-forming substrate may alternatively be any other sort of substrate, for example, a gas substrate, a gel substrate, or any combination of the various types of substrate.

Preferably, the aerosol-forming substrate comprises an aerosol former.

As used herein, the term 'aerosol former' is used to describe any suitable known compound or mixture of compounds that, in use, facilitates formation of an aerosol and that is substantially resistant to thermal degradation at the operating temperature of the aerosol-generating article.

Suitable aerosol-formers are known in the art and include, but are not limited to: polyhydric alcohols, such as propylene glycol, triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate Preferred aerosol formers are polyhydric alcohols or mixtures thereof, such as propylene glycol, triethylene glycol, 1,3-butanediol and, most preferred, glycerine.

The aerosol-forming substrate may comprise a single aerosol former. Alternatively, the aerosol-forming substrate may comprise a combination of two or more aerosol formers.

Preferably, the aerosol-forming substrate has an aerosol former content of greater than 5% on a dry weight basis.

The aerosol aerosol-forming substrate may have an aerosol former content of between approximately 5% and approximately 30% on a dry weight basis.

In a preferred embodiment, the aerosol-forming substrate has an aerosol former content of approximately 20% on a dry weight basis.

In the disclosure there is also provided an aerosol generating system comprising a charger and an aerosol-generating device. The charger may comprise a housing defining a cavity for receiving the aerosol-generating device to be charged. The cavity may have an opening. At least one electrical contact may be located in the cavity. The charger may comprise a cover. The cover may comprise a plurality of moveable elements actuatable between an open position and a closed position. Each of the moveable elements may have an inner surface facing the cavity when in the closed position. At least a portion of the inner surface of at least one of the moveable elements of the cover may define a profiled engagement member having a leading edge and a trailing edge. The profiled engagement member may slope into, or towards, the cavity when the respective moveable element is in the closed position. The slope may increase in a direction from the leading edge to the trailing edge of the profiled engagement member. When the aerosol-generating device is received in the cavity, the profiled engagement member may be configured to urge the aerosol-generating device into engagement with the at least one electrical contact when the plurality of moveable elements are in the closed position.

In one example of the aerosol generating system, the charger comprises: a housing defining a cavity for receiving the aerosol-generating device to be charged, the cavity having an opening, at least one electrical contact being located in the cavity; and a cover comprising a plurality of moveable elements actuatable between an open position and a closed position, each of the moveable elements having an inner surface facing the cavity when in the closed position, in which; at least a portion of the inner surface of at least one of the moveable elements of the cover defines a profiled engagement member having a leading edge and a trailing edge, the profiled engagement member sloping into, or towards, the cavity when the respective moveable element is in the closed position, the slope increasing in a direction from the leading edge to the trailing edge of the profiled engagement member; wherein when the aerosol-generating device is received in the cavity, the profiled engagement member is configured to urge the aerosol-generating device into engagement with the at least one electrical contact when the plurality of moveable elements are in the closed position.

Features of the charger described above may apply to the charger of the aerosol-generating system.

When the plurality of moveable elements are in the open position, the aerosol-generating device can be received by the charger in the cavity. When the cover is in the closed position, the aerosol-generating device is protected from dust and dirt of the surroundings. In the closed position, the cover also prevents users from altering the position of the aerosol-generating device within the charger and electrical contact between the at least one electrical contact of the charger and the aerosol-generating device is ensured. Such a charger, advantageously, allows for reliable and efficient charging of the aerosol-generating device received in the cavity.

Urging the aerosol-generating device into engagement with the at least one electrical contact ensures that electrical communication is retained between the aerosol-generating device and the charger.

Preferably, each of the plurality of moveable elements may comprise a profiled engagement member sloping into, or towards, the cavity when the respective moveable element is in the closed position, the slope increasing in a direction from the leading edge to the trailing edge of the profiled engagement member. Each of the profiled engagement members may engage the aerosol-generating device when the moveable elements are in the closed position. This advantageously ensures there are multiple points of contact between the plurality of moveable elements and the aerosol-generating device.

Preferably, when more than one moveable element comprises a profiled engagement member, the slope of each of the profiled engagement members is the same.

The cover may comprise an actuating plate. The actuating plate may be in the shape of a ring. The actuating plate may be concentric with the cavity. The cover may comprise a base plate in the shape of a ring. The base plate ring may be concentric with the cavity. The base plate ring may be positioned inside the actuating plate ring. Alternatively, the actuating plate ring may be positioned inside the base plate ring. The inner ring of the base plate and the actuating plate may have a diameter that corresponds to the dimensions of the cavity opening. For example, the diameter of the inner ring may be equal to the diameter of the cavity opening.

The actuating plate may be configured to be rotatable with respect to the charger housing. The actuating plate may be configured to be rotatable with respect to the charger housing. Each of the plurality of moveable elements may be connected to the actuating plate. The may be via an actuation arm fixed to the actuating plate at one end and fixed to the moveable element at another end.

Each of the plurality of moveable elements may also be connected to the base plate. Alternatively, each of the plurality of moveable elements may also be connected to the charger housing. The connection to the base plate or the charger housing may be via a pin formed in the base plate or the charger housing.

The actuating plate may be rotatable relative to the base plate and charger housing. By connecting each of the plurality of moveable elements to the actuating plate and to the base plate or charger housing, rotating the actuating plate may actuate the moveable elements from the open position to the closed position.

The connection of each of the plurality of moveable elements to the base plate or charger housing may be offset relative to each of the connections of the plurality of moveable elements to the actuation ring such that rotation of the actuation plate causes the moveable elements to actuate around a pivot.

The cover may comprise an iris mechanism. The iris mechanism may comprise the plurality of moveable elements. The iris mechanism may also comprise the actuating plate. The iris mechanism may also comprise the base plate.

The cover may comprise between 2 and 6 moveable elements. The plurality of moveable elements may not overlap in the closed position. The plurality of moveable elements may not overlap in the open position. A non-overlapping arrangement advantageously allows for least one of the moveable elements having a profiled engagement member.

The charger may comprise an aerosol-generating device release mechanism. The aerosol-generating device release mechanism may be located in the cavity. The aerosol-generating device release mechanism may comprise a resilient element.

The at least one electrical contact of the charger may be a resilient element. The resilient element may be configured to apply a force to an aerosol-generating device received in the cavity in the direction of the cavity opening when the cover in the closed position.

The charging device may comprise a primary power source. The primary power source may be electrically couplable to the at least one electrical contact of the charger. The aerosol-generating device may comprise a secondary power source. The secondary power source may be electrically couplable to the at least one electrical contact of the aerosol-generating device. Electrical communication between the primary power source and the secondary power source may allow the primary power source to be used to recharge the secondary power source. Therefore, the or each profiled engagement member ensuring connection between the aerosol-generating device and the charger advantageously ensures that the primary source recharges the secondary power source when the aerosol-generating device is received in the charger and the cover is in the closed position.

The cavity of the charger may have dimensions that substantially correspond to the dimensions of the aerosol-generating device to be received in the cavity. The length of the cavity from its opening to its closed end is preferably substantially similar to the length of the aerosol-generating device to be received in the cavity.

The or each profiled engagement member may protrude into, or towards, the cavity when the plurality of moveable elements are in the closed position.

The or each profiled engagement member may be a cam surface and a surface of the aerosol-generating device received in the cavity may be a cam rider.

The plurality of moveable elements, in sliding between the open position and the closed position, may move in an actuation plane.

The charger may comprise an actuation member. The charger may comprise a means to actuate the plurality of moveable elements from the open position to the closed position in response to manipulation of the actuation member by a user of the charger.

The actuation member may be a slider. The means to actuate the plurality of moveable elements may be a mechanical linkage between the slider and the cover. The means to actuate the plurality of moveable elements may be a mechanical linkage between the slider and the actuation plate of the cover.

Alternatively, the actuation member may be a slider. The means to actuate the plurality of moveable elements may be a mechanical linkage between the slider and the cover. The means to actuate the plurality of moveable elements may be a mechanical linkage between the slider and the actuation plate of the cover.

Alternatively, the actuation member may be a button or switch. The means to actuate the plurality of moveable elements may comprises an actuator and a mechanical linkage between the actuator and the cover. The mechanical linkage may be between the actuator and the actuation plate of the cover.

The plurality of moveable elements may be biased towards the closed position.

In this disclosure there is provided a method of using an aerosol-generating system comprising a charger and an aerosol-generating device; the charger comprising: a housing defining a cavity for receiving the aerosol-generating device to be charged, the cavity having an opening, at least one electrical contact being located in the cavity; and a cover comprising a plurality of moveable elements actuatable between an open position and a closed position, each of the moveable elements having an inner surface facing the cavity when in the closed position, in which; at least a portion of the inner surface of at least one of the moveable elements of the cover defines a profiled engagement member having a leading edge and a trailing edge, the profiled engagement member sloping into, or towards, the cavity when the respective moveable element is in the closed position, the slope increasing in a direction from the leading edge to the trailing edge of the profiled engagement member; the method comprising:

inserting the aerosol-generating device into the cavity of the charger when the plurality of moveable elements are in the open position; and actuating the moveable elements from the open position to the closed position;

wherein, in the closed position, the profiled engagement member urges the aerosol-generating device into engagement with the at least one electrical contact.

While an aerosol-generating device is received in the cavity, and the plurality of moveable element are in the closed position, the charger may charge the aerosol-generating device. A controller in the charger may couple a primary power supply of the charger with the at least one electrical contact of the charger. The aerosol-generating device, being engaged with the at least one electrical contact, may be in electrical communication with the at least one electrical contact, for example, via at least one electrical contact on the aerosol-generating device. A secondary power supply, located in the aerosol-generating device may, therefore, be charged by the primary power supply of the charger. The charging of the aerosol-generating device may be regulated by the controller of the charger.

The method may also comprise the step of actuating the moveable elements from the closed position to the open position when a user wants to use the aerosol-generating device received in the charger.

The charger may comprise an aerosol-generating device release mechanism. When the cover slides to the open position, the aerosol-generating device release mechanism may urge the aerosol-generating device out of the cavity of the charger. This may advantageously urge a portion of the aerosol-generating device out of the cavity. The user of the aerosol-generating system may use this portion to pull the aerosol-generating device out of the cavity.

The step of sliding the cover from the open position to the closed position (or vice versa) may comprise a user manipulating the cover of the charger directly. Alternatively, the charger may comprise an actuation member in the form of a rotational disk, a slider, a switch or a button, the manipulation of which operates the cover. Manipulation of the actuation member may cause the moveable elements to be actuated from the open position to the closed position.

The plurality of moveable elements may be biased towards the closed position. In that case, the step of inserting an aerosol-generating device into the cavity of the device may comprise applying a force on the moveable elements against the bias to hold the cover in the open position. This force may be applied be a user directly on the moveable elements. Alternatively, the force may be applied via the means to actuate the cover. The step of sliding the cover from the open position to the closed position may comprise removing the force holding the cover in the open position such that the cover moves to the closed position automatically, as a result of the biasing element.

Features described in relation to one example or embodiment may also be applicable to other aspects and embodiments. For example, features described in relation to aerosol-generating articles and aerosol-generating systems described above may also be used in conjunction with methods of using aerosol-generating articles and aerosol-generating systems described above.

Specific embodiments will now be described with reference to the figures, in which:

FIG. 1 shows a schematic illustration of a known electrically operated aerosol-generating system comprising an aerosol-generating article, an aerosol-generating device and a charging device for charging the aerosol-generating device;

FIG. 2 shows a perspective view of a charger comprising a cover slidable between an open position and a closed position. In this embodiment, the charger is cylindrical and comprises an actuation member in the form of a rotatable disc. The cover in FIG. 2 is shown in schematically;

FIG. 3 shows a plan view of the cover separately from the charger of FIG. 2. FIG. 3*a* shows the cover in an open position. FIG. 3*b* shows the cover in a (nearly) closed position;

FIG. 4 shows a cross-sectional perspective view of the charger of FIG. 2. FIG. 4*a* shows the cover in an open position. FIG. 4*b* shows the cover in a closed position. FIG. 4*c* shows the cover in an intermediate position, between the open position and the closed position;

FIG. 5 show a close-up perspective view of one of actuatable elements of the cover of FIGS. 2 to 4, separately from the rest of the cover;

Figure 1:
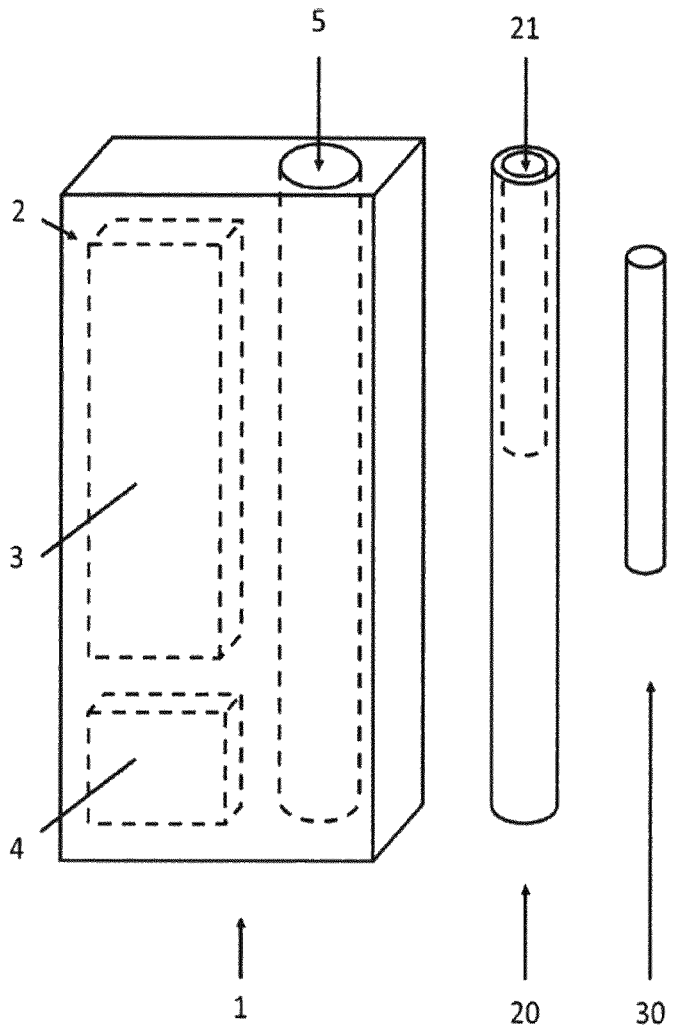

FIG. 1 shows a schematic illustration of a known electrically operated aerosol-generating system. The known electrically operated aerosol-generating system comprises a charger 1, an aerosol-generating device 20 and an aerosol-generating article 30.

The charger 1 comprises a housing 2 having the general size and shape of a conventional packet of cigarettes. A lithium-ion battery 3 and electric circuitry 4 are housed within the charger 1. The charger 1 further comprises a generally circularly-cylindrical cavity 5 for receiving the aerosol-generating device 20. The cavity 5 is defined by the housing 2. An electrical contact (not shown) is arranged at a closed end of the cavity 5 for electrically connecting an aerosol-generating device received in the cavity 5 to the battery 3 of the charging device 1.

The aerosol-generating device 20 is substantially circularly cylindrical and has the general dimensions of a conventional cigar. The length of the device 20 is substantially identical to the length of the cavity 5 and the diameter of the device 20 is slightly smaller than the diameter of the cavity 5, such that the device 20 fits closely in the cavity 5. The aerosol-generating device 20 comprises an open cavity 21 at a proximal end for receiving an aerosol-generating article. The aerosol-generating device 20 further comprises a battery (not shown) housed in the housing of the device and an electric heater (not shown) arranged in the cavity 21 for heating at least a portion of the aerosol-generating article 30 when the aerosol-generating article 30 is received in the cavity 21.

The aerosol-generating article 30 comprises an aerosol-forming substrate (not shown) comprising a gathered, crimped sheet of tobacco, and a filter (not shown) arranged back to back with the aerosol-forming substrate in the form of a rod. The aerosol-generating article 30 has a diameter substantially equal to the diameter of the cavity 21 of the device 20 and a length longer than the cavity 21, such that when the article 30 is received in the cavity 21 of the device 20, the filter extends out of the cavity 21 and may be drawn on by a user, similarly to a convention cigarette.

In use, a user inserts the article 30 into the cavity 21 of the device 20 and turns on the device 20 to activate the electric heater. The electric heater heats the aerosol-forming substrate of the article 30 such that volatile compounds of the aerosol-forming substrate are released and atomised to form an aerosol. The user draws on the mouthpiece of the article 30 and inhales the aerosol generated from the heated aerosol-forming substrate. After use of the device 20, the article 30 may be removed from the device 20 for disposal, and the device 20 may be placed into the charger 1 for storage and for charging of the battery of the device 20.

Figure 2:
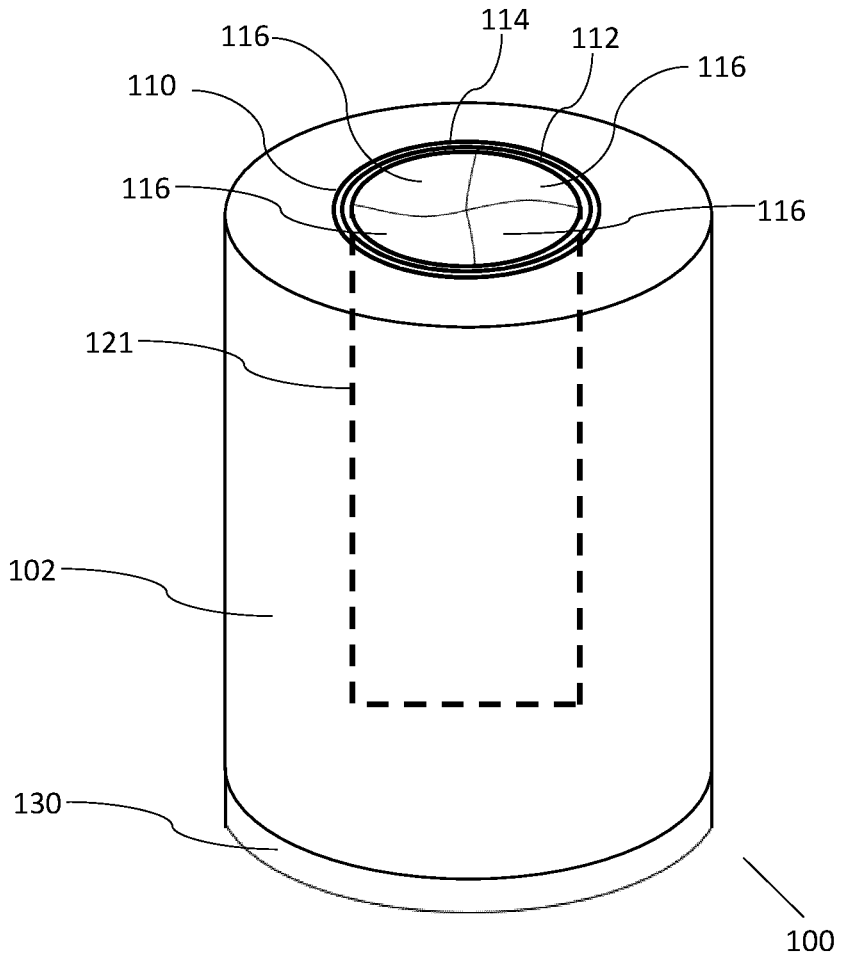

FIG. 2 shows a perspective view of a charger 100 comprising a charger housing 102, a cover 110 and an actuation member in the form of a rotatable disc 130. The charger also comprises two electrical contacts (not shown in FIG. 2) located in the cavity and a power supply in the form of a rechargeable battery (not shown).

The charger housing 102 has a cylindrical shape. The rotatable disc 130 also has a cylindrical shape. The diameter of the rotatable disc 130 is the same as the diameter of the charger housing 102, and the rotatable disc 130 is concentric to the charger housing 102.

Figure 3A:
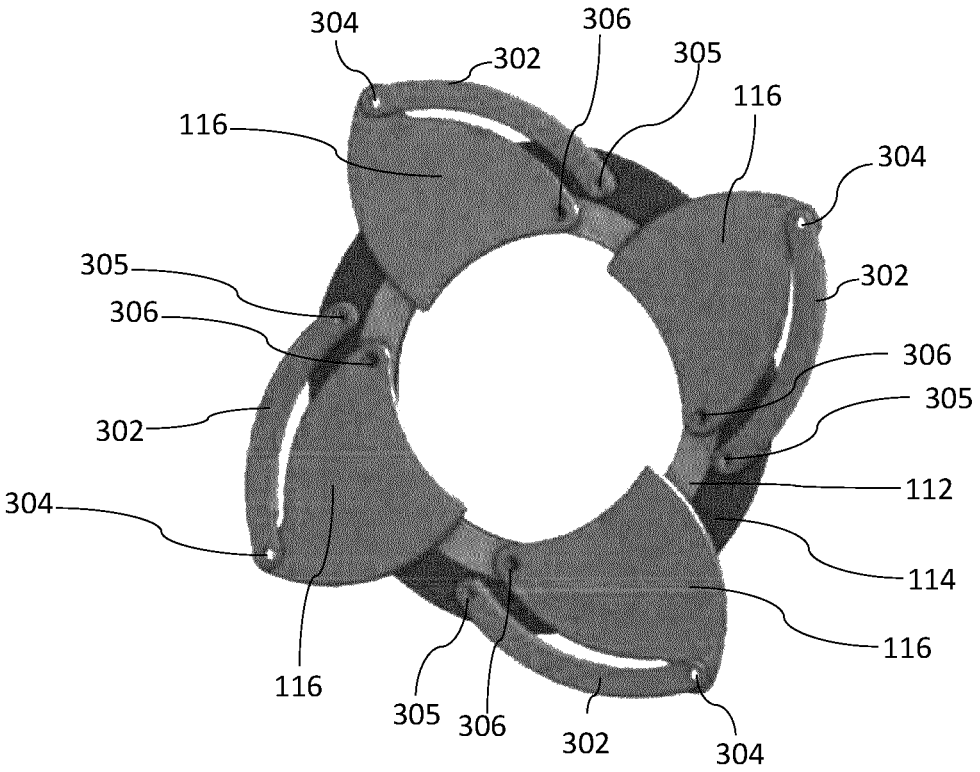

The cover 110 is shown schematically in FIG. 2. A more detailed view of the cover is shown in FIG. 3. The cover comprises a base plate ring 112, an actuation ring 114 and four moveable elements 116. In FIG. 2, the moveable elements 116 are shown in a closed position wherein each individual moveable element is in contact with two other moveable elements. The moveable elements 116 do not overlap. The moveable elements 116 are shaped such that the contact between the moveable elements creates a continuous surface when the moveable elements 116 are in the closed position.

A cavity 120 for receiving an aerosol-generating device is defined in the charger housing 102. The cavity 120 comprises cavity walls 122 and a cavity opening 124, which is defined in a top surface 104 of the charger housing 102. The cavity opening 124 is aligned with the cover. Because the cavity is formed within the charger housing, and the cover 110 is shown in a closed position in FIG. 2, the cavity 120, cavity walls 122 and cavity opening 124 are not visible. However, the position of the cavity within the charger is represented by dotted line 121. The features of the cavity 120 can be seen in FIG. 4.

The moveable elements 116 are actuatable between an open position and a closed position.

The cover is shown separately to the rest of the charger 100 in FIG. 3. The cover comprises an iris mechanism. Each of the moveable elements 116 is connected to the base plate ring 112 and the actuating plate ring 114. The connection of each of the moveable elements 116 to the base plate ring is via pins formed in the base plate ring 112. Each pin is connected to a moveable element 116 at connection 306 on the respective moveable element 116. The moveable elements can rotate about connection 306.

The connection of the moveable elements 116 to the actuation ring 114 is via a connection arm 302. Each connection arm is connected to a moveable element at connection 304 at one end of the connection arm 302. The other end of the connection arm 302 is connected to the actuation ring 114 via a pin in the actuation ring 114. Each moveable element 116 can rotate about connection 304 and each actuating arm 302 can rotate about actuation point 305.

The actuation ring 112 is rotatable relative to the base plate ring 114. Rotation of the actuation ring 112 actuates the moveable elements 116. This actuation is possible because each of the connections 304, 305 and 306 allows for rotation about the connection and because of the offset of the points of connection. Therefore, when the actuation ring 114 rotates, the moveable elements 116 are actuated from the open position, shown in FIG. 3*a*, to the nearly closed position shown in FIG. 3*b*. By connecting the moveable elements 116 via connection arm 302, rather than directly to the actuation ring (as is common in iris mechanisms), the motion of each of the moveable elements 116 can be configured to avoid any overlap with other moveable elements in either the open position or the closed position. This advantageously allows for the inner surface of the moveable elements to be sloped to form a profiled engagement member, as described below.

Figure 3B:
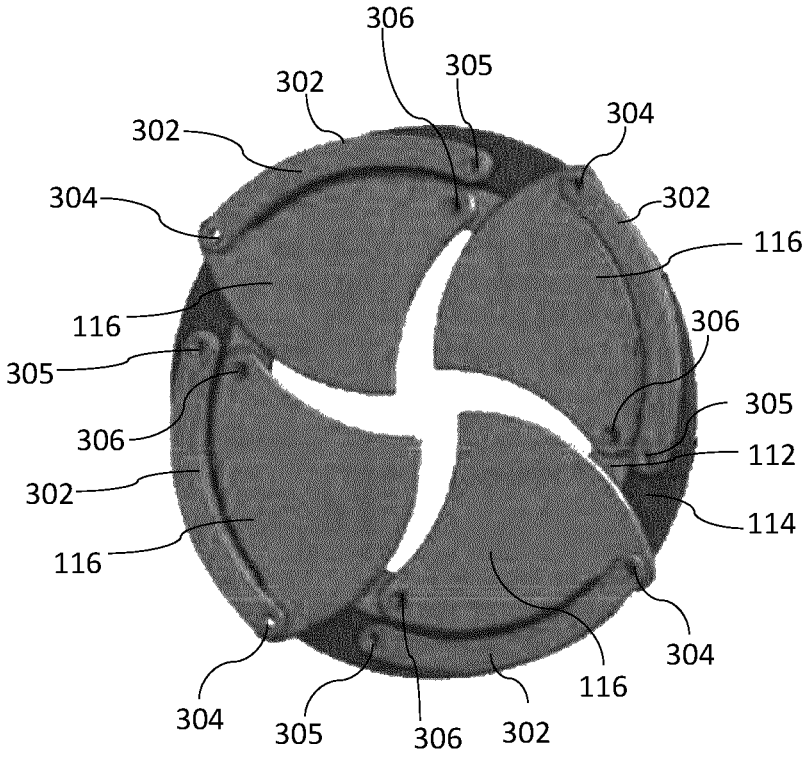

FIG. 3*b* shows the moveable elements in a nearly closed position where the moveable elements have not completed reached the closed position shown in FIG. 2 (i.e. a position where the moveable elements form a continuous surface).

The diameter of the actuation ring 114 corresponds to the diameter of the cavity 120 (the cavity is cylindrical). The actuation ring 114 is also concentric to the cavity 120. Therefore, when the moveable elements 116 are in the open position, the cavity 120 is accessible such that an aerosol-generating device can be received by the charger 100 in the cavity 120. In the closed position, the moveable elements 116 are positioned to close the cavity 120 by facing the cavity 120. Closing the cavity protects the cavity 120 from dust and dirt of the surroundings and prevents users from altering the position of an aerosol-generating device received within the cavity of the charger. The charger housing 102 acts as a case for the aerosol-generating device received in the cavity and provides protections to the aerosol-generating device.

The moveable elements 116, in the closed position, also act to ensure electrical contact between an aerosol-generating device received in the cavity and the electrical contacts of the charger (not shown in FIG. 2) received in the cavity. This is described in more detail below with reference to FIGS. 4 and 5.

Figure 4A:
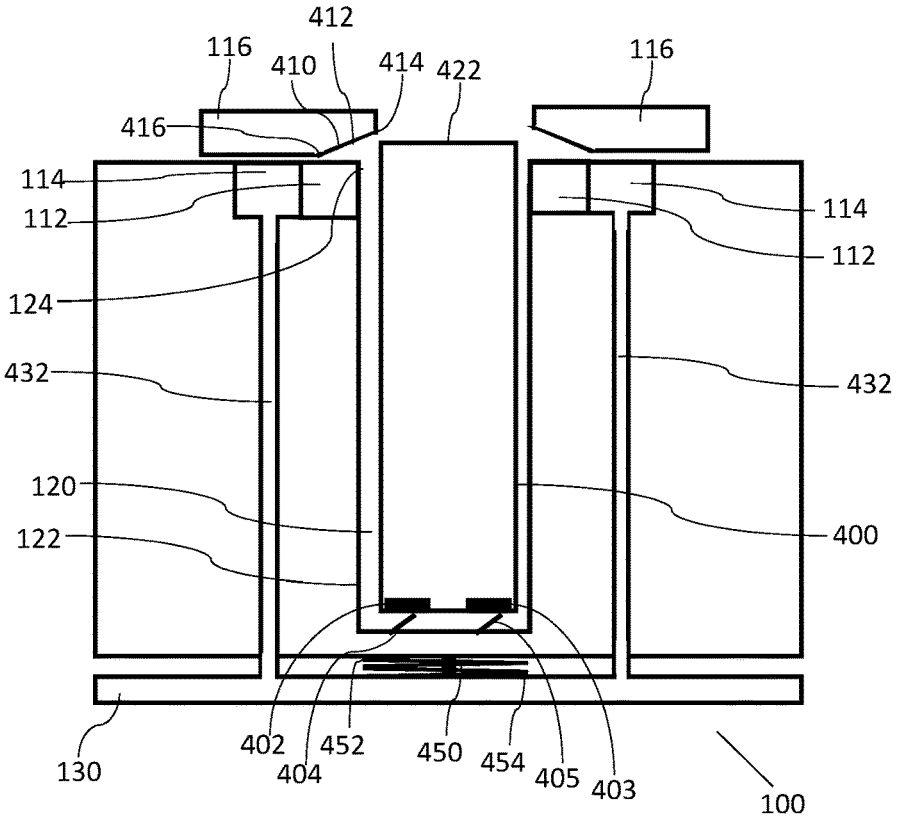
Figure 4B:
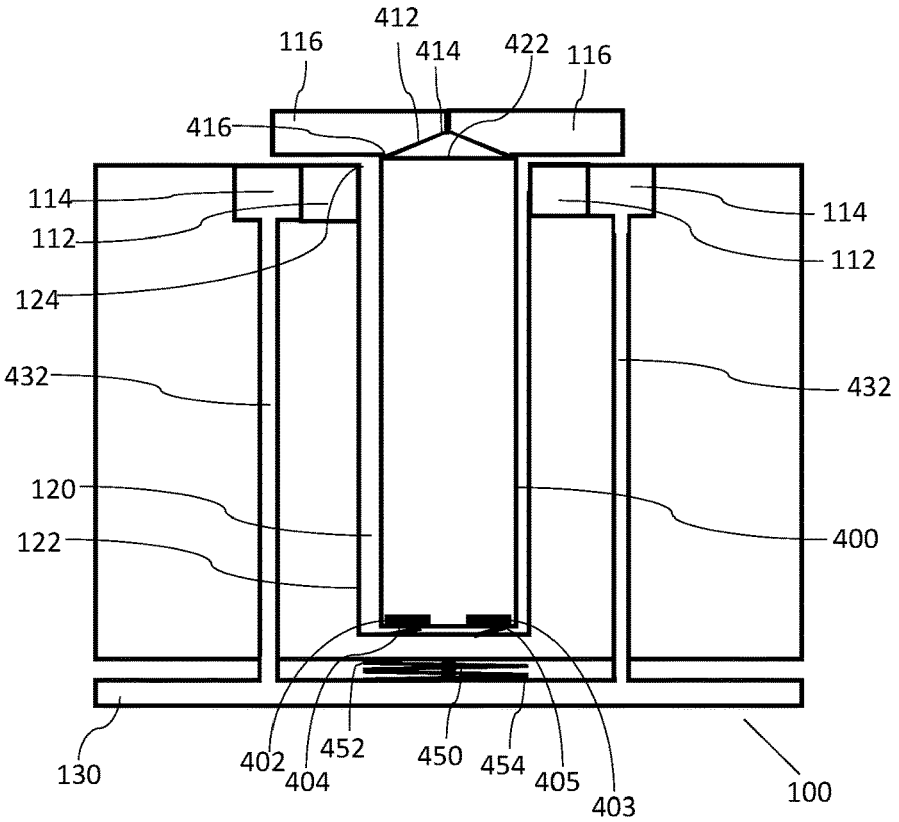

FIG. 4 shows a cross-sectional schematic view of the charger 100 with an aerosol-generating device 400 received in the cavity 120. Two of the four moveable elements 116 can be seen in the cross-section. FIG. 4*a* shows the moveable elements 116 in the open position. FIG. 4*b* shows the moveable elements 116 in the closed position. FIG. 4*c* shows the moveable elements in an intermediate position between the open position of FIG. 4*a* and the closed position of FIG. 4*b*.

Each of the moveable elements 116 comprises an inner surface 410, a portion of which defines a profiled engagement member 412. The profiled engagement member 412 comprises a leading edge 414 and a trailing edge 416. As shown in FIG. 4*b*, the profiled engagement member 412 slopes towards the cavity 120 when the moveable elements 116 are in the closed position. The slope of the profiled engagement member 412 increases in a direction from the leading edge 414 to the tailing edge 416.

The slope of the profiled engagement member 412 is shown more clearly in FIG. 5 which is a perspective view of an actuation member 116 shown separately to the rest of the cover. The slope of the profiled engagement member 412 increases from the leading edge 414, defined at the furthest point of the profiled engagement member 412 from the two connection points 304 and 306, to the trailing edge 416. After the trailing edge, the thickness of the moveable element 116 remains constant, defining a portion 502. Portion 502 of the inner surface does not engage the aerosol-generating device received in the cavity as it extends over other features of the cover (for example, the base plate ring 112) when the moveable element is in the closed position.

The aerosol-generating device comprises two electrical contacts 402 and 403. The aerosol-generating device also comprises a power supply in the form of a rechargeable battery (not shown). The rechargeable battery of the aerosol-generating device is electrically couplable with the two electrical contacts 402 and 403.

Two electrical contacts 404 and 405 are located in the cavity of the charger. Electrical contacts 402 and 403 of the aerosol-generating device are aligned with electrical contacts 404 and 405 of the charger when the aerosol-generating device is received in the cavity. When there is electrical connection between the electrical contacts of the charger with the electrical contacts of the aerosol-generating device, the rechargeable battery of the charger can be used to recharge the rechargeable battery of the aerosol-generating device. In order for the rechargeable battery to be reliably charged, the electrical connection much the consistent.

Electrical contacts 404 and 405 are resilient elements in the form of cantilever springs. As shown in FIG. 4*a*, the electrical contacts 404 and 405 extend upwards from the closed end of the cavity in the direction of the cavity opening when the moveable elements 116 are in the open position. When an aerosol-generating device 400 is received in the cavity, and the moveable elements are in the open position, the aerosol-generating device rests upon electrical contacts 404 and 405 (provided the charger remains upright).

The cavity extends from the closed end where the electrical contacts 404 and 405 are located, to the cavity opening 124. In this embodiment, the base plate 112 is set into the charger housing such that the top of the base plate is aligned with the top of the cavity opening 124. The aerosol-generating device 400 has a length which is substantially the same as the length of the cavity. However, because of the upward extension of the electrical contacts 404 and 405, the aerosol-generating device received in the cavity, resting upon the electrical contacts 404 and 405, extends above the level of the cavity opening 124.

When the moveable elements 116 are in the open position, electrical communication between the electrical contacts 402 and 404 and 403 and 405 is not ensured and so may not be consistent. For example, if the charger 100 is not stored in an upright position, or is shaken or dropped, it is likely that the electrical communication will not be maintained between the electrical contacts.

When the moveable elements 116 are in the closed position, electrical communication between the electrical contacts 402 and 404 and 403 and 405 is ensured. This is because, in the closed position, the profiled engagement members 412 engage the top surface 422 of the aerosol-generating device 400 received in the cavity 120. The engagement ensures that the aerosol-generating device 400 is in electrical communication with electrical contacts 402 and 404 and 403 and 405, irrespective of the orientation of the charger and of any sudden forces applied to the charger, for example in the case that the charger is dropped. In other words, the engagement ensures that contact is maintained between the electrical contacts 402 and 403 of the charger and the electrical contacts 404 and 405 of the aerosol-generating device.

Electrical communication is ensured because the profiled engagement members 412 apply a force to the top surface 422 of the aerosol-generating device, pushing it into the cavity 120 and in the direction of, and against the electrical contacts 404 and 405. The applied force causes the electrical contacts 404 and 405 to deform and so generate a reactive force that urges the aerosol-generating device 400 to move away from the electrical contacts 404 and 405 (i.e. a reactive force pushing the aerosol-generating device 400 back out the cavity 120). As the moveable elements 116 are in the closed position, the reactive force applied by the electrical contacts 404 and 405 urges the aerosol-generating device against the moveable elements 116 and, in particular, against the profiled engagement members 412. This arrangement ensures contact between the aerosol-generating device 400 and the electrical contacts of the charger 404 and 405.

In the embodiment shown in FIG. 4, the profiled engagement members 412 are configured to first engage the top surface 422 of the aerosol-generating device 400 received in the cavity 120 at an intermediate position (i.e. a position between the open position the closed position) of the cove. This is the position shown in FIG. 4*c*.

As the moveable elements 116 are actuated from the open position to the closed position, each of the profiled engagement members 412 moves into an overlapping relationship with the cavity 120. It is the leading edge 414 that moves into an overlapping relationship with the cavity first. As a result of the profiled engagement members being sloped, each of the profile engagement members 412 increasingly protrudes towards the cavity as moveable elements 116 approach the closed position. At the intermediate position shown in FIG. 4*c*, the overlapping is such that the profiled engagement members 116 protrude towards the cavity sufficiently to first contact and engage the top surface 422 of the aerosol-generating device 400. Such an arrangement results in a smooth engagement between the profiled engagement portion and the aerosol-generating device 300.

Each profiled engagement member 412 remains engaged with the aerosol-generating device 400 as the moveable element 116 is actuated from the intermediate position of FIG. 4*c* to the closed position of FIG. 4*b*. As the profiled engagement members 412 increasingly protrude towards the cavity, an increasing force is applied on the aerosol-generating device 300 urging the aerosol-generating device into contact with the electrical contacts 404 and 405. In turn, the electrical contacts 404 and 405 are increasingly deformed from their extended state and so apply an increasing reactive force, urging the aerosol-generating device back out of the cavity.

Each profiled engagement member 412 follows a similar path, engaging the aerosol-generating device 400 at an equivalent point in the motion of the respective moveable element 116. The slopes of each of the profiled engagement members 412 are the same. Therefore, each profiled engagement member 412 protrudes similarly towards the cavity at equivalent points in the motion of the respective moveable element 116 compared to the profiled engagement members 412 of the other moveable elements 116. This results in the same force being applied on the aerosol-generating device from each side by each of the moveable elements ensuring that an even force is applied to the aerosol-generating device. This also ensures that the force is evenly distributed between the moveable elements 116.

Each profiled engagement member 412 acts as a cam surface and the aerosol-generating device 400 acts as a cam rider following the motion of cam surfaces. The transverse motion of the profiled engagement members 412, as the moveable elements are actuated from the open position to the closed position, is transferred to longitudinal motion of the aerosol-generating device 400 into the cavity.

As has already been described, the moveable elements 116 are actuated as a result of the actuation ring 114 rotating relative to the base plate ring 112. In the embodiment shown in FIGS. 2 and 4, the charger is provided with an actuation member in the form of a rotating disk 130 and it is this actuation member which causes the rotation of the actuation ring 114 relative to the base plate ring 112, and so actuates the moveable elements 116.

The rotatable disc 130 rotates about a point aligned with the centre of the actuation plate 114. Two rigid shafts 432 attach the rotatable disc 130 to the actuation ring 114. The rigid shafts 432 pass through hollow defined in the charger housing 102. When a user rotates the rotatable disc 130, the rotational motion is transferred directly from the rotatable disc 130 to the actuation ring 114 by the rigid shafts 432. Therefore, a user can manipulate the moveable elements 116 by rotation of the rotatable disc 130.

Attached to the rotatable disc 130 is a biasing element in the form of a coil 450. The coil 450 is attached to the charger housing 102 at a first end 452 and attached to the rotatable disc 130 at a second end 454. The coil is a resilient element and is configured such that the natural, undeformed state of the coil 450 is when the rotatable disc 130 is in a position such that the moveable elements 116 are in the closed position. When the rotatable disc 130 is in a position such that the moveable elements 116 are in the open position, the spring 450 is in a deformed state. Therefore, when the moveable elements 116 are in the open position, the spring 450 applies a force to the rotatable disc 130 urging the rotatable disc to rotate to a position where the moveable elements 116 close the cavity 120.

Whenever the moveable elements 116 are in the open position, or an intermediate position between the open position and the closed position, the moveable elements 116 are urged back towards the closed position by the coil 450 applying a force on the rotatable disc 130. This prevents the user of the charger from inadvertently leaving the cover in the open position. Furthermore, if the cover is accidently forced open, the coil 450 will automatically close the cover again.

While the coil 450 is shown as being attached to the rotatable disc 130 at one end and the charger housing 102 at the other, other designs are possible. Any biasing element which is in a natural state when the moveable elements 116 are in the open position but deformed when the movable elements 116 are in the open position by the relative motion of one component relative to another component, will have the same effect. For example, a biasing element can be attached at one end to the actuation ring 114 and attached at the other end to the base plate ring 112. In another example, a biasing element can be attached to each of the moveable elements. The other end of the each of the biasing elements can be attached to the base plate ring 112.

Figure 6:
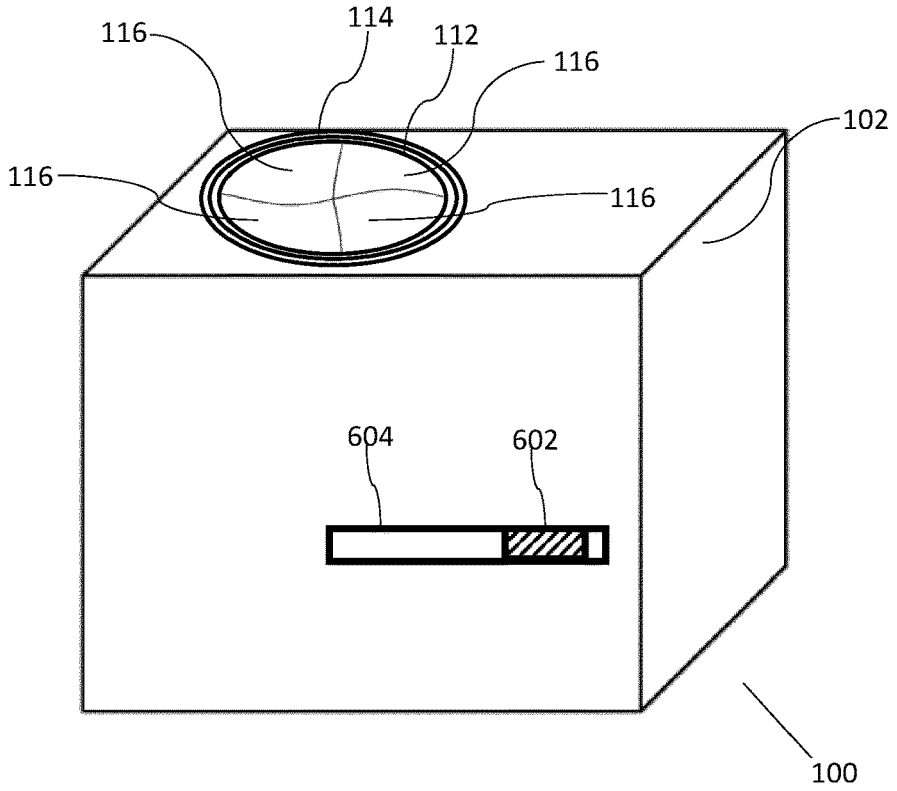
FIG. 6 shows another embodiment of the charger where the actuation member is a slider.

FIG. 6 shows a perspective view an embodiment of the charger comprising a slider tab 602 as an actuation member, rather than a rotatable disc. In this embodiment, the charger housing 102 has a parallelepiped shape.

The slider tab 602 can slide along an elongated opening 604 in the charger housing 102. At the position of the slider tab 602 shown in FIG. 6, the moveable elements 116 are in the closed position. Sliding the slider tab 602 along the elongated opening 604 actuates the moveable elements 116 to the open position. The cover of FIG. 6 is the same as described in relation to the previous embodiments. However, in this embodiment, the sliding motion of the sliding tab 602 has to first be converted to rotational motion before being transferred to the actuation ring 114. This is shown in FIG. 7 which is a cross-sectional schematic view of charger shown in FIG. 6.

Figure 7:
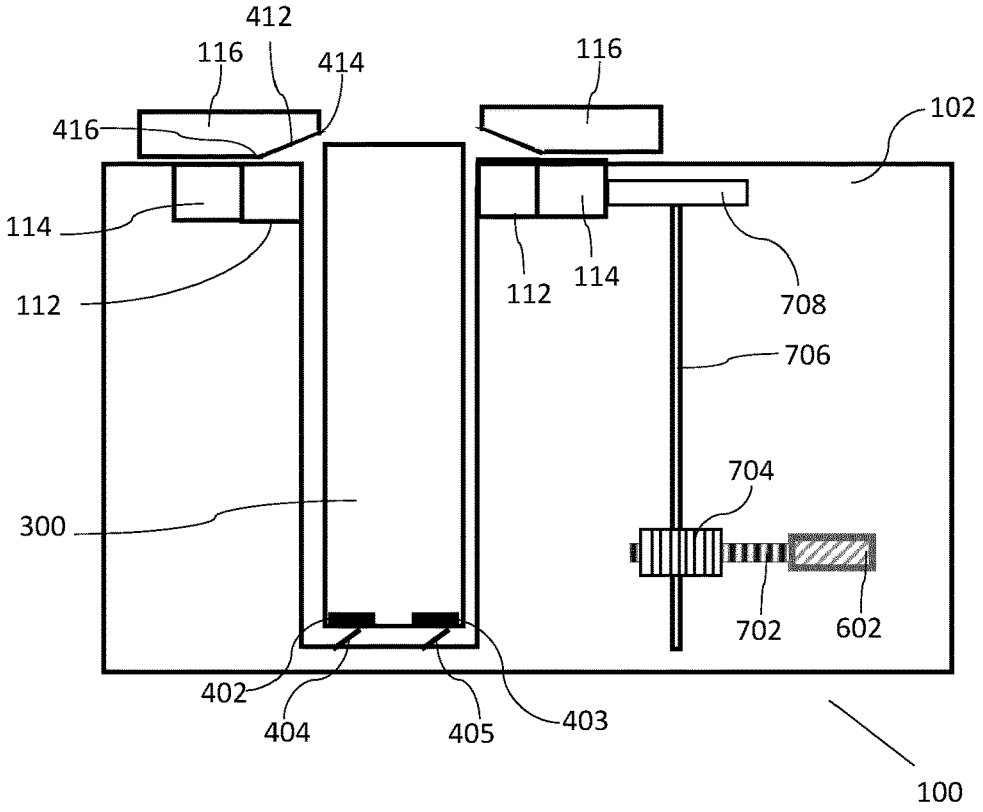
FIG. 7 shows a cross-sectional schematic view of the charger of FIG. 6.

FIG. 7 shows how the slider tab 602 is attached to a toothed rail 702 which engages a cog 704. The toothed rail 702 and cog 704 have a rack and pinion relationship. Moving the slider tab 602 causes linear motion of the toothed rail 702 (the rack). The toothed rail 701 is engaged with the cog 704 (the pinion) such that the linear motion of the toothed rail 702 causes the cog 704 to turn. This converts the liner motion of the slider tab 602 to rotational motion of the cog 704.

The cog 704 is attached to a rigid shaft 706. At one end of the rigid shaft 706 is a wheel 708. The wheel 708 is in contact with the actuation ring 114 of the cover 110. When the cog 704 turns in response to linear motion of the slider 602, this also turns the rigid shaft 706 causing the wheel 708 to turn. Friction between the wheel 708 and the actuation ring 114 forces the actuation ring to rotate relative to the base plate ring 112. Therefore, sliding the slider tab 602 actuates the moveable elements 116.

A biasing element (not shown) can be attached to the slider tab 602 at one end, and to the charger housing 102 at the other end. The natural state of the biasing element is when the slider tab 602 is in a position such that the moveable elements 116 are in the closed position. Sliding the slider tab 602 along the elongated opening 604 deforms the biasing element.

In some embodiments, the charger comprises an actuation member in the form of a button or switch (not shown) positioned in the charger housing 102, instead of a slider or a rotatable disc. A user can manipulate the button or switch which sends signals to a controller (not shown). The controller then controls an electric motor configured to actuate the moveable elements 116 from the open position to the closed position in response to the manipulation.

Figure 8:
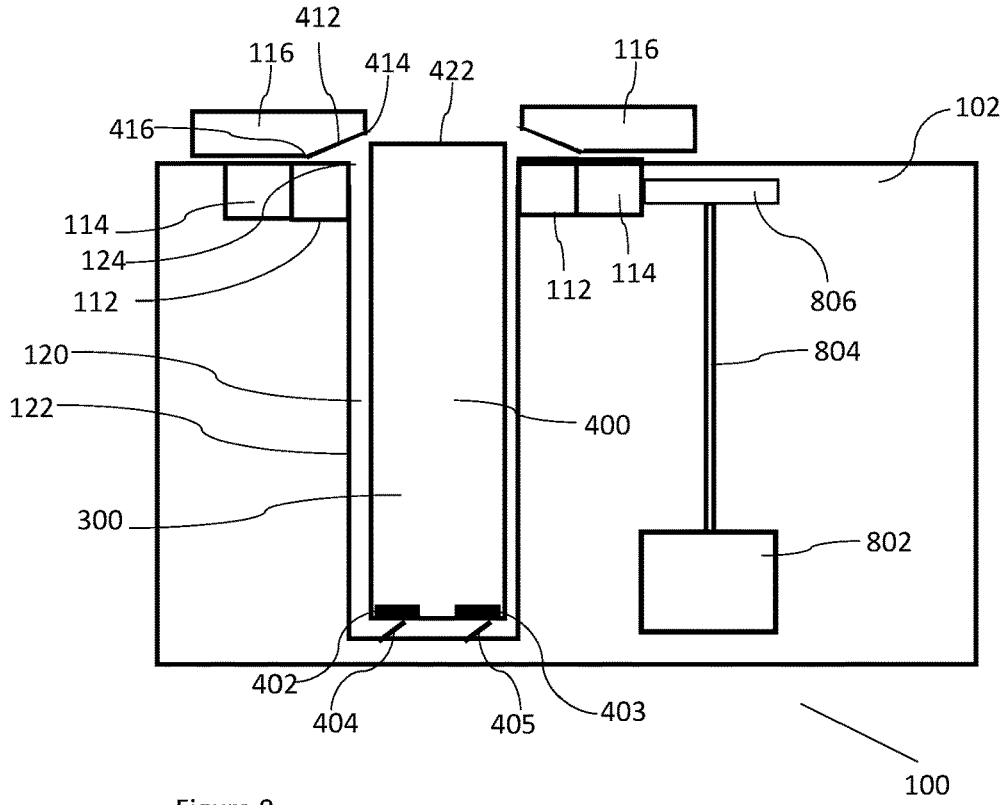
FIG. 8 shows a cross-sectional schematic view of another embodiment of the charger where the actuation means is an electric motor.

FIG. 8 shows a cross-sectional view of a charger comprising an electric motor 802. The electric motor 802 replaces the rack and pinion arrangement of FIG. 7. A rigid shaft 804 is connected to the electric motor 802. The electric motor 802 is configured to receive electric signals from the button or switch via the controller. When a user presses the button or switches the switch, the controller causes the electric motor to rotate the rigid shaft 804. This, in turn, rotates a wheel 806, positioned at the end of the rigid shaft 804. The wheel 806 is in contact with the actuation ring 114 and friction between the actuation ring 114 and the wheel means that the rotation of the wheel 806 rotates the actuation ring 114, actuating the moveable elements 116.

Figure 9:
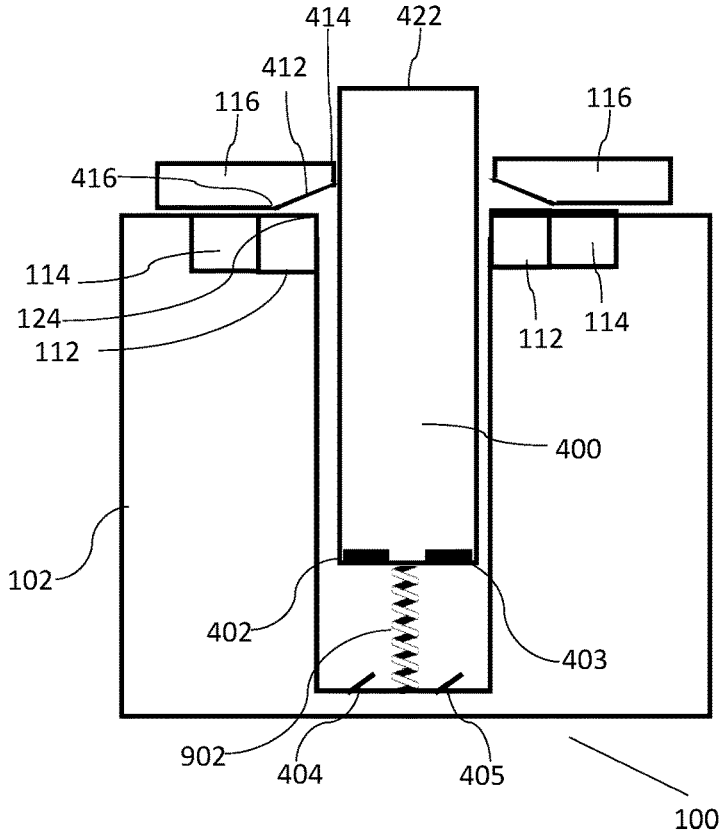
FIG. 9 shows a cross-sectional schematic view of an embodiment of the charger comprising an aerosol-generating device release mechanism.

FIG. 9 shows a cross-sectional schematic view of a charger comprising an aerosol-generating device release mechanism. The cover 110 is shown in the open position. The aerosol-generating device release mechanism is a helical spring 902 located in the cavity 120 between electrical contacts 404 and 405. The helical spring is configured to urge the aerosol-generating device out of the cavity 120 (i.e. above the cavity opening 12), when the cover is in the open position. The spring 902 pushes on the bottom surface 904 of the aerosol-generating device 400. By urging the aerosol-generating device 400 out of the cavity, the aerosol-generating device 400 can be more easily removed from the charger by a user of the device. This is because a portion of the aerosol-generating device upon which a user can hold on to is provided.

When the cover is in the closed position, the spring 902 is compressed and the aerosol-generating device is pushed against the electrical contacts 404 and 405, as described previously. However, in order to close the cover, a user of the device is required to manually push the aerosol-generating device below the level of the cover 110 such that the profiled engagement members are able to move into an overlapping relationship with the cavity.

Figure 10:
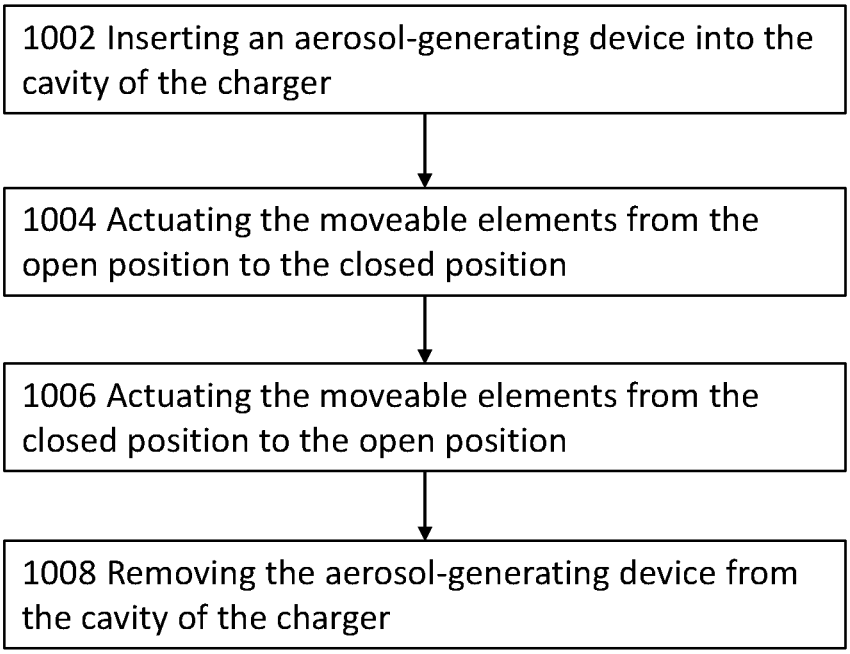
FIG. 10 shows a flow diagram of a method of using an aerosol-generating system comprising a charger and an aerosol-generating device.

FIG. 10 is a flow diagram outlining a method of using aerosol-generating systems according to the disclosure.

At step 1002, the aerosol-generating device is received into the cavity of a charger. This is when the moveable elements are in the open position.

At step 1004, a user actuates the moveable elements from the open position to the closed position. As described, the moveable elements engage the aerosol-generating device as the moveable elements are actuated to the closed position. In the closed position, the cover urges the aerosol-generating device into engagement with at least one electrical contact. This ensures that the electrical connection between the aerosol-generating device and the charger is maintained and allows the aerosol-generating device to be reliably charged by the charger when the moveable elements are in the closed position.

In order to the actuate the moveable elements, the user manipulates an actuation member. As described, the actuation member may be in the form of a rotatable disc, a slider, a button or a switch.

At step 1006, a user actuates the moveable elements from the closed position to the open position. A user does this in order to access the aerosol-generating device received in the cavity and remove the aerosol-generating device (as per step 1008 of the method).

In some embodiments, the moveable elements are biased closed. In these embodiments, the moveable elements automatically return to the closed position from the open position. Therefore, step 1004 may be automatic.

In the open position, the aerosol-generating device is urged out of the cavity by an aerosol-generating device release mechanism. By urging the aerosol-generating device out of the cavity, a portion of the aerosol-generating device extends out of the cavity. A user of the aerosol-generating system can use this portion to aid removable of the aerosol-generating device. When the charger comprises an aerosol-generating device release mechanism, step 1004 may require the user to manually push the aerosol-generating device into the cavity, compressing the aerosol-generating device release mechanism, before actuating the moveable elements to the closed position.

The invention claimed is:

1. A charger for charging an aerosol-generating device, the charger comprising:

a housing defining a cavity configured to receive the aerosol-generating device to be charged, the cavity having an opening;

at least one electrical contact disposed in the cavity; and a cover comprising a plurality of moveable elements actuatable between an open position and a closed position, each of the moveable elements having an inner surface facing the cavity when in the closed position, wherein at least a portion of the inner surface of at least one of the moveable elements of the cover defines a profiled engagement member having a leading edge and a trailing edge, and wherein the profiled engagement member slopes into, or towards, the cavity when the respective moveable element is in the closed position, the slope increasing in a direction from the leading edge to the trailing edge of the profiled engagement member.

2. The charger according to claim 1, wherein each of the plurality of moveable elements comprises a profiled engagement member sloping into, or towards, the cavity when the respective moveable element is in the closed position, the slope increasing in the direction from the leading edge to the trailing edge of the profiled engagement member.

3. The charger according to claim 1, wherein the cover further comprises an actuating plate rotatable with respect to the charger housing, and wherein rotation of the actuation plate actuates the plurality of moveable elements from the open position to the closed position.

4. The charger according to claim 1, wherein the cover further comprises an iris mechanism and the plurality of moveable elements form part of the iris mechanism.

5. The charger according to claim 1, wherein the cover further comprises between 2 and 6 moveable elements.

6. The charger according to claim 1, wherein, in the closed position, the moveable elements do not overlap.

7. The charger according to claim 1, wherein the profiled engagement member is configured to urge the aerosol-generating device received in the cavity into engagement with the at least one electrical contact when the plurality of moveable elements are actuated from the open position to the closed position.

8. The charger according to claim 1, wherein the profiled engagement member is a cam surface, and a top surface of the aerosol-generating device received in the cavity is a cam rider.

9. The charger according to claim 1, wherein, in actuating between the open position and the closed position, the plurality of moveable elements move in an actuating plane, and wherein the profiled engagement member slopes out of the actuating plane.

10. The charger according to claim 1, further comprising an actuation member and a means to actuate the plurality of moveable elements of the cover in response to manipulation of the actuation member by a user of the charger.

11. The charger according to claim 10, wherein the actuation member is a rotatable disc or a slider, and the means to actuate the plurality of moveable elements of the cover is a mechanical linkage between the actuation member and the cover.

12. The charger according to claim 10, wherein the actuation member is a button or switch, and the means to actuate the plurality of moveable elements of the cover comprises an electric motor and a mechanical linkage between the electric motor and the cover.

13. The charger according to claim 10, further comprising an aerosol-generating device release mechanism configured to apply a force to the aerosol-generating device received in the cavity in a direction of the cavity opening when the plurality of moveable elements are in the closed position.

14. An aerosol generating system, comprising:

a charger; and an aerosol-generating device, the charger comprising:

a housing defining a cavity configured to receive the aerosol-generating device to be charged, the cavity having an opening, at least one electrical contact disposed in the cavity, and a cover comprising a plurality of moveable elements actuatable between an open position and a closed position, each of the moveable elements having an inner surface facing the cavity when in the closed position, wherein at least a portion of the inner surface of at least one of the moveable elements of the cover defines a profiled engagement member having a leading edge and a trailing edge, wherein the profiled engagement member slopes into, or towards, the cavity when the respective moveable element is in the closed position, the slope increasing in a direction from the leading edge to the trailing edge of the profiled engagement member, and wherein, when the aerosol-generating device is received in the cavity, the profiled engagement member is configured to urge the aerosol-generating device into engagement with the at least one electrical contact when the cover is in the closed position.

15. A method of using an aerosol-generating system, the aerosol-generating system comprising:

a charger and an aerosol-generating device, the charger comprising:

a housing defining a cavity configured to receive the aerosol-generating device to be charged, the cavity having an opening, at least one electrical contact disposed in the cavity, and a cover comprising a plurality of moveable elements actuatable between an open position and a closed position, each of the moveable elements having an inner surface facing the cavity when in the closed position, wherein at least a portion of the inner surface of at least one of the moveable elements of the cover defines a profiled engagement member having a leading edge and a trailing edge, and wherein the profiled engagement member slopes into, or towards, the cavity when the respective moveable element is in the closed position, the slope increasing in a direction from the leading edge to the trailing edge of the profiled engagement member; and the method comprising:

inserting the aerosol-generating device into the cavity of the charger when the cover is in the open position; and moving the cover from the open position to the closed position, wherein, in the closed position, the profiled engagement member of the cover urges the aerosol-generating device into engagement with the at least one electrical contact.

* * * * *